US005803669A

United States Patent [19]

Bullard

[11] Patent Number: 5,803,669

[45] Date of Patent: Sep. 8, 1998

[54] THERMAL-INSULATED CONCRETE FORMING SYSTEM

[76] Inventor: Waymon Bullard, 4542 Raeford Rd., Fayetteville, N.C. 28304

[21] Appl. No.: 747,527

[22] Filed: Nov. 12, 1996

Related U.S. Application Data

[60] Provisional application No. 60/009,961, Jan. 16, 1996.

[51] Int. Cl.[6] ..... E04B 2/00

[52] U.S. Cl. ..... 405/257; 52/309.11; 52/427; 405/252

[58] Field of Search ..... 405/229, 233, 405/250–252, 256, 257; 52/309.11, 426, 427, 442

[56] References Cited

U.S. PATENT DOCUMENTS

| | | | |
|---|---|---|---|
| 4,335,548 | 6/1982 | Rehbein | 52/169.11 |
| 4,505,019 | 3/1985 | Deinzer | 52/309.11 X |
| 4,698,947 | 10/1987 | McKay | 52/309.11 X |
| 4,711,058 | 12/1987 | Patton | 52/101 |
| 4,884,382 | 12/1989 | Horobin | 52/426 |
| 4,886,399 | 12/1989 | Pidgeon | 405/229 |
| 4,894,969 | 1/1990 | Horobin | 52/564 |
| 4,938,449 | 7/1990 | Boeshart | 249/216 |
| 5,140,794 | 8/1992 | Miller | 52/309.12 |
| 5,174,083 | 12/1992 | Mussell | 52/169.1 |

*Primary Examiner*—Tamara L. Graysay
*Assistant Examiner*—Tara L. Mayo
*Attorney, Agent, or Firm*—Mills Law Firm PLLC; Clifford F. Rey

[57] ABSTRACT

A thermal insulated concrete forming system for casting a concrete slab and a foundation wall of a building simultaneously is disclosed. The concrete forming system is designed for use with a pre-existing standard concrete footing that is constructed about the periphery of a concrete slab to be poured. The concrete forming system consists of a plurality of elongated, rectangular panels which are arranged in parallel, vertically opposed relation. The panels are fabricated from thermal-insulating materials having exceptional insulating characteristics capable of being expressed as a specific R value in accordance with commercial specifications. The thermal-insulated panels are interconnected by a plurality of brace members extending therebetween and being spaced at predetermined intervals so as to provide a form work for concrete to be cast therein. The thermal-insulated panels are assembled in a predetermined relationship to control the vertical elevation and thickness of a concrete slab and a foundation wall which are simultaneously cast therein the concrete forming system is disposed on a top surface of a standard concrete footing and remains in place to provide peripheral insulation of the slab and foundation wall to reduce the heating and cooling load on the building so constructed. The concrete forming system can be pre-assembled in accordance with appropriate dimensions in a workshop in preparation for pouring a concrete slab on a remote job site.

8 Claims, 2 Drawing Sheets

THERMAL-INSULATED CONCRETE FORMING SYSTEM

CLAIM OF BENEFIT OF PROVISIONAL APPLICATION

This application claims the benefit of United States Provisional application Ser. No. 60/009,961 filed on Jan. 16, 1996 by Waymon Bullard for Thermal Brake Foundation System.

BACKGROUND OF INVENTION

1. Field of Invention

This invention relates to concrete forming systems and, more particularly, to a method and apparatus for casting a building foundation and slab floor simultaneously.

In the conventional practice, constructing a house with a concrete slab floor is a labor-intensive process.

First, laborers must dig a trench of sufficient depth into which concrete will be poured to become a footing for the foundation wall.

Next, a row of concrete building blocks are set in position within the inner periphery of the footing below grade level.

Thereafter, a masonry worker builds a short brick wall adjacent to and externally of the concrete block. The brick wall extends to a predetermined vertical elevation above the concrete block corresponding to the thickness of the slab floor. The concrete block together with the brick wall serves as a form into which concrete will be poured to form the slab floor.

A persistent problem with this method is the intensive labor and time required to mix mortar and to install the brick foundation wall. In addition, the availability of the brick mason presents scheduling conflicts for the builder.

Further, brick does not provide any thermal insulation factor in order to insulate the foundation wall and, thus, imposes an additional heating and cooling load on the house.

Concrete forming systems for the casting of so-called floating slab building foundations with perimeter insulation are known in the prior art. The term floating slab in this context refers to casting the footing, foundation wall, and slab floor simultaneously. For example, U.S. Pat. No. 5,174,083 to Mussell discloses such a concrete forming system for floating slab construction.

However, such floating slab forming systems, though useful in the construction of commercial buildings, are not appropriate for residential construction in that they do not meet residential building codes for concrete slab houses for various reasons.

Thus, the present invention has been developed to solve the above problems and other shortcomings of the prior art thereby reducing the heating and cooling load on the house and providing obvious economic advantages.

2. Description of Related Prior Art

U.S. Pat. No. 5,174,083 to Barry D. Mussell discloses a concrete forming system for the casting of floating slab building foundations with perimeter insulation. The forming system provides form work assemblies to be pre-assembled into long lengths which provide straight and level slab edges, perimeter insulation, and finished exterior surfaces.

U.S. Pat. No. 5,140,794 to Brian J. Miller discloses a forming system for a hardenable material having the form work unit including a pair of wall panels arranged in a predetermined upright spaced relation and a skeletal grid assembly disposed therebetween. The skeletal grid assembly includes locking means for interconnecting with a grid assembly of a second form unit of like construction disposed in side by side relation therewith.

U.S. Pat. No. 4,938,449 to Patrick E. Boeshart discloses a tie for concrete forms including an elongated strap member with opposing first and second ends. The strap member has an upwardly projecting intermediate portion which prevents the movement of form panels inwardly on the strap. Beveled ends allow the strap to be forced through a polystyrene panel without the need for forming an aperture in the panel for insertion of the tie.

U.S. Pat. No. 4,335,548 to Erwin G. Rehbein discloses a foundation insulating skirt including a sheet of insulating material to placed in contact with the outside perimeter of a foundation, and an outer protective shield for the panel. The invention has utility as an insulating skirt for the outside of the footings of floating slab constructions and the like.

U.S. Pat. No. 4,711,058 to Edward J. Patton discloses an insulated concrete form including a metallic sheet member and an angular locking flange and insect barrier attached along the upper edge of an insulated barrier. Conventional pre-positioned wooden stakes are held tightly against the outside surface of the concrete form with form clips in preparation for pouring concrete therein. Only the stakes and clips need to be removed, as the remainder of the form becomes an integral part of the floor structure.

Finally, U.S. Pat. Nos. 4,884,382 and 4,894,969 to David D. Horobin disclose modular building-block forms for constructing concrete wall structures wherein the block form is formed from expandable polystyrene material to provide a lightweight, rigid, box-like structure adapted to receive the concrete therein.

SUMMARY OF THE INVENTION

After much research and study of the above mentioned problems, the present invention has been developed to provide a thermal insulated concrete forming system to permit the casting of a concrete slab and a supporting peripheral foundation wall simultaneously.

The concrete forming system includes elongated, thermal-insulated form panels which are arranged in parallel relation about the peripheral edge of a concrete slab to be poured.

The vertically opposed form panels are interconnected by metallic brace members at predetermined intervals defining a plurality of spaces therebetween to receive the poured concrete therein.

The form panels are configured and dimensioned so as to define the vertical elevation and the thickness of the finished slab in order to conform to applicable building codes.

The thermal-insulated form panels remain in place after the slab is complete to provide peripheral insulation to reduce the heating cooling load on the building so constructed.

In view of the above, it is an object in the present invention to provide a concrete forming system wherein a concrete slab together with a peripheral foundation wall may be cast simultaneously.

Another object of the present invention is to provide a concrete forming system fabricated from a polystyrene insulation board having exceptional insulating characteristics which remains in place after the slab is complete to provide peripheral insulation thereof reducing the heating and cooling load on the building.

Another object of the present invention is to provide a concrete forming system that is configured to control the vertical elevation and thickness of a concrete slab to predetermined dimensions.

Another object of the present invention is to provide a concrete forming system which may be pre-assembled in accordance with a blueprint dimensions in the workshop in preparation for pouring a concrete slab on the job site.

Other objects and advantages of the present invention will become apparent and obvious from a study of the following description and the accompanying drawings which are merely illustrative of such invention.

DETAILED DESCRIPTION OF THE PREFERRED EMBODIMENT

Figure 1:
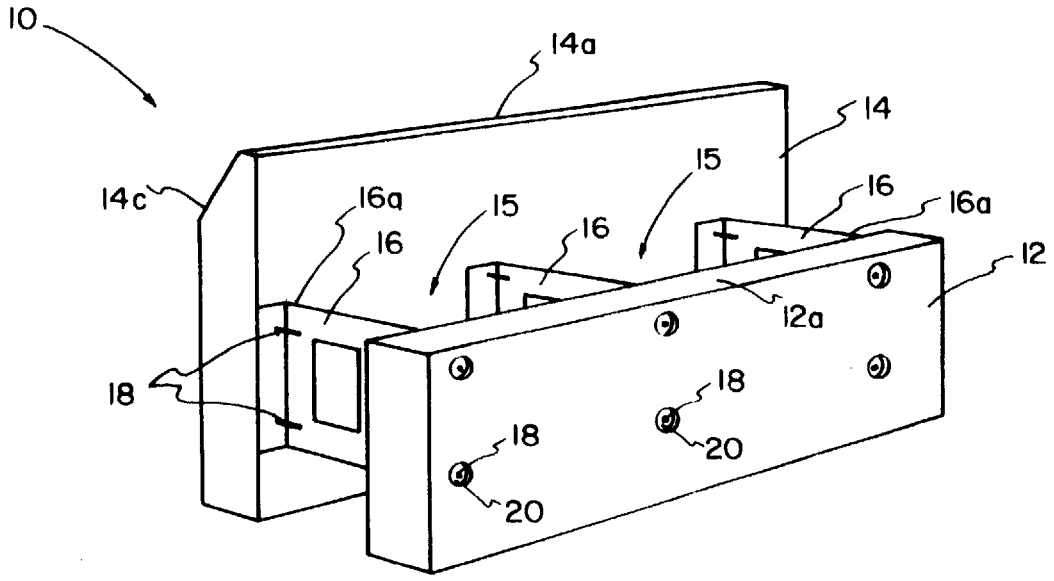
FIG. 1 is a perspective view of the thermal-insulated, concrete forming system of the present invention.

A concrete forming apparatus in accordance with the present invention is illustrated in FIG. 1 and indicated generally at 10.

The concrete forming system 10 includes a pair of elongated, generally rectangular form panels 12 and 14 which are arranged in parallel, spaced-apart relation.

In the preferred embodiment, panels 12 and 14 are fabricated from a rigid, polystyrene insulation board having exceptional insulating characteristics capable of being expressed as a specific R-value in accordance with various commercial specifications.

Since such foam insulating board is well known to those skilled in the art, further detailed discussion of the same is not deemed necessary.

The vertically opposed form panels 12 and 14 are interconnected by a plurality of generally U-shaped brace members 16 which are fixedly mounted transversely between panel 12 and panel 14 at predetermined intervals. The U-shaped braces 16 are arranged vertically in generally perpendicular relation to panels 12 and 14 and define a plurality spaces therebetween, indicated generally at 15, to receive poured concrete therein. Brace members 16 are secured to the inner surfaces of panels 12 and 14 by a plurality of sheet metal screws 18 or other suitable fastening means.

Figure 2:
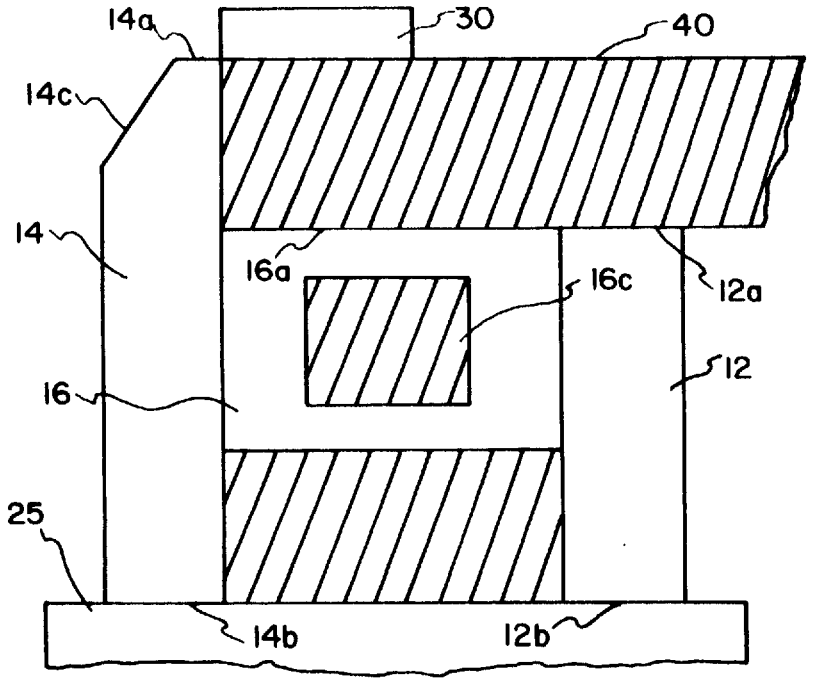
FIG. 2 is a cross-sectional view of a preferred embodiment of the concrete forming system showing a concrete slab formed therein.

Critical to the present invention is the spacial relationship between panels 12 and 14. It will be appreciated that the bottom surfaces 12*b* and 14*b*of panels 12 and 14 occupy a common horizontal plane which rest on a conventional footing 25 as shown in FIG. 2.

However, the top edge 14*a* of the outer panel 14 extends to a higher vertical elevation than that of the upper edge 12*a* of panel 12. This arrangement permits the flow of wet concrete over upper edge 12*a* and into spaces 15 during the concrete pouring operation.

In the preferred embodiment, braces 16 include a central opening 16*c*which permits the flow of wet concrete between adjacent spaces 15. Braces 16 are spaced at predetermined intervals to conform with applicable building codes for concrete structures.

Thus, concrete fills the system 10 up to the level of the top edge 14*a*which defines the highest vertical elevation of the finished slab 40.

It will be appreciated that the difference in vertical elevation between top edge 14*a* and upper edge 12*a* determines the thickness of the finished slab 40 which must conform to applicable building codes.

Outer panel 14 includes a beveled outside corner 14*c* which reduces the width of top edge 14*a* to approximately ⅝ inch in the preferred embodiment.

This enables a 2×4 inch wall plate 30 to be positioned almost entirely on the concrete at the periphery of the slab without overhanging the foam insulation panel 14 as shown in FIG. 2.

Figure 3:
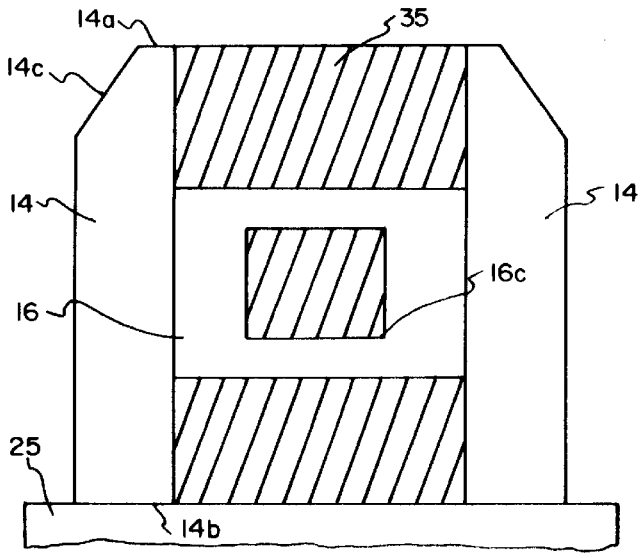
FIG. 3 is a cross-sectional view of an alternative embodiment of the concrete forming system showing a concrete foundation wall formed therein.

In an alternative embodiment, the concrete forming system 10 may consist of a pair of opposed panels 14 when only a foundation wall 35 is to be cast to support a wood floor construction as shown in FIG. 3.

In an assembly procedure for the concrete forming system 10 of the present invention, form panels 12 and 14 are arranged adjacent opposite ends of a plurality of brace members 16. It can be seen that in this assembled configuration, the upper edges 16*a* of brace members 16 and the upper edge 12*a* of form panel 12 define a common horizontal plane.

Sheet metal screws 18 extend through form panels 12 and 14 from the outside surfaces thereof In the preferred embodiment screws 18 are self-tapping for convenience of assembly. Each screw 18 includes a flat washer 20 disposed thereon which is designed to prevent each respective screw 18 from being pulled through the foam insulating panels 12 and 14 as screw 18 is advanced into brace member 16 to retain the same in its functional position.

In this manner form panels 12 and 14 may be pre-assembled in accordance with blueprint dimensions in the workshop in preparation for pouring a concrete slab 40 on the job site.

Figure 4:
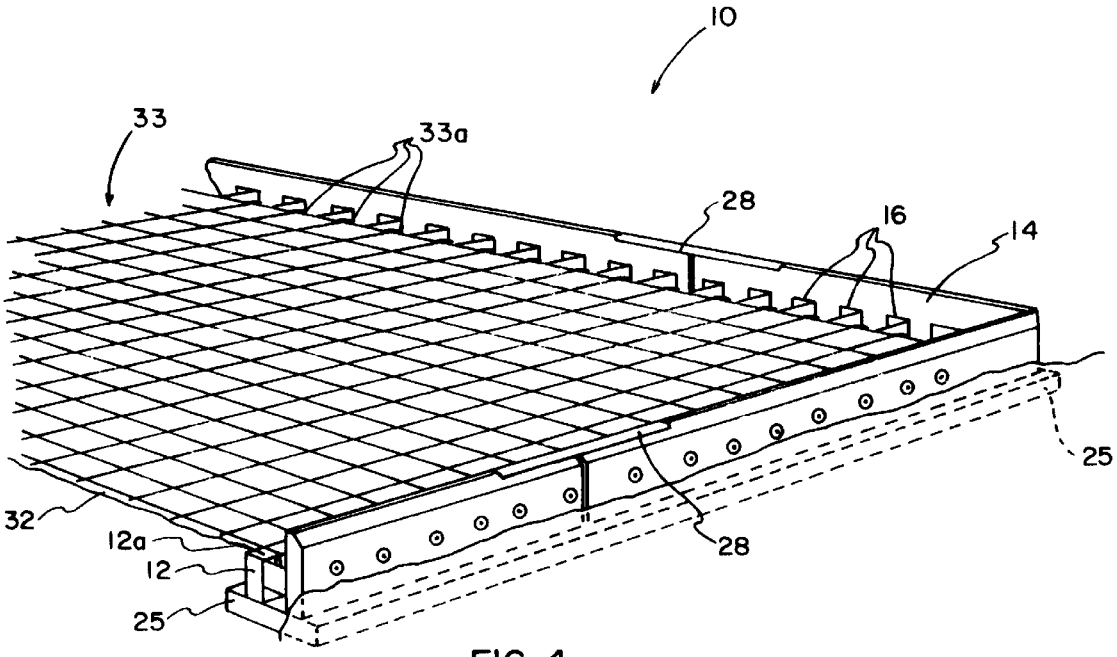
FIG. 4 is a perspective view of the concrete forming system of the present invention disposed on an excavation site in preparation for pouring concrete therein.

In normal use, the concrete forming system of the present invention will be used in conjunction with a standard poured-in-place concrete footing 25 as shown in FIG. 4.

Thus, after the footing 25 is completed the present invention is disposed on top of the pre-existing footing 25 with the form panel 14 being disposed outwardly and defining the outer edge of the concrete slab 40 to be poured. Once installed in this position above the footing 25, the footing ditch (not shown) is backfilled with soil to secure the same in position.

An elongated channel member 28 conforming to the dimensions of top edge 14*a* and beveled corner 14*c* may be attached thereto to secure adjacent sections of the concrete forming system 10 in alignment as seen in FIG. 4.

Next, the soil within the perimeter of the footing 25 and under the slab 40 to be poured is graded and compacted to the same level as the upper surface 12*a* of form panel 12.

Thereafter, a moisture barrier 32 is laid down over the soil within the perimeter if required by existing building codes.

Since such moisture barriers are well known to those skilled in the art, further detailed discussion of the same is not deemed necessary.

Next, a gridwork of reinforcing wire, indicated generally at 33, is overlaid on the moisture barrier 32. The terminal ends 33*a* of the wire gridwork 33 extend over the upper edge 12*a* of form panel 12 and into the spaces 15 defined by adjacent brace members 16.

Thereafter, wet concrete is poured within the concrete forming system 10 of the present invention filling the spaces 15 between form panels 12 and 14 above the pre-existing footing 25 and extending into the area defining the slab 40 in one continuous pour such that the concrete fills the forming system 10 up to the upper edge of form panel 14 wherein the slab 40 is finished in the conventional manner.

After the slab 40 has cured, the insulated form panels 12 and 14 remain in place providing an insulating layer from external changes in weather and temperature.

The outer form panel 14 may be partially cut away, as necessary, to provide for inspection of the foundation after the concrete work is complete. Thereafter, the exterior surface of form panel 14 may be finished with a layer of stucco coating (not shown) to protect the foam panel 14 and to seal it where the same meets the footing 25 to provide a barrier to termites.

Since such stucco coatings are well know to those skilled in the art, further detailed discussion of the same is not deemed necessary.

From the above it can be seen that the concrete forming system and method of using same provides a practical and efficient means of pouring a concrete foundation wall and slab simultaneously. The concrete form panels are fabricated from a foam insulation board having exceptional insulating characteristics and, thus, provide a thermal barrier to insulate the foundation wall and reduce the heating and cooling load on the building.

The terms "upper", "lower", "side", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

I claim:

1. A thermal-insulated concrete forming system for casting a concrete slab and a foundation wall simultaneously on a pre-existing footing, said footing defining a periphery of said slab, said system comprising:

a plurality of elongated, rectangular concrete forming panels being fabricated from thermal-insulating material, said panels being arranged in generally parallel, spaced-apart relation and defining a space therebetween wherein concrete is poured to form said slab and said foundation wall, said panels being disposed in functional relation to a top surface of said footing, said panels being configured and dimensioned in pre-determined relationship to control the vertical elevation and thickness of said slab; and interconnecting means including a plurality of brace members extending between said panels and being spaced at pre-determined linear intervals therebetween, said brace members being generally U-shaped in cross-section and including a long leg member and a pair of opposed short leg members being integrally formed in perpendicular relation thereto, said brace members being arranged vertically intermediate said panels, said short leg members abutting the inner surfaces of said panels to maintain a pre-determined dimension therebetween to control the thickness of said foundation wall enabling said slab and said slab foundation wall to be cast simultaneously.

2. The concrete forming system of claim 1 wherein said concrete forming panels include an inner panel member and an outer panel member, each respective panel member having a top edge and a bottom edge thereof, said inner and said outer panel members being arranged such that said bottom edges of each respective panel member lie in the same horizontal plane and said top edge of said inner panel member is defined by a horizontal plane having a lower vertical elevation than a parallel plane defining said top edge of said outer panel member such that the difference in vertical elevation corresponds to the thickness of said concrete slab.

3. The concrete forming system claim 2 were in said top edge of said outer panel member includes a beveled angle comer formed on an upper, outer edge thereof and along the entire length thereof.

4. The concrete forming system of claim 2 wherein said panels are adapted for being coupled in an end-to-end relation utilizing attachment means extending between adjacent sections of said outer panel members.

5. The concrete forming system of claim 4 wherein said attachment means include an elongated channel member conforming to the dimensions of the top edges of said outer panel members, said channel members functioning to secure adjacent sections of said outer panel members in longitudinal alignment.

6. The concrete forming system of claim 1 wherein said thermal-insulating material includes insulating characteristics capable of being expressed as a specific R-value.

7. The concrete forming system of claim 1 wherein said short leg members of said brace members are secured to said panels by conventional sheet metal screws.

8. The concrete forming system of claim 7 wherein each said long leg members of said brace member includes a central opening formed therein to permit the flow of concrete therethrough.

* * * * *